United States Patent [19]

Tisma

[11] Patent Number: 5,010,929

[45] **Date of Patent: * Apr. 30, 1991**

[54] FAST ACTING DOUBLE LOADING SYSTEM FOR AUTOMATIC PACKAGING MACHINE

[75] Inventor: Steven Tisma, Chicago, Ill.

[73] Assignee: Tisma Machine Corporation

[ * ] Notice: The portion of the term of this patent subsequent to Aug. 15, 2006 has been disclaimed.

[21] Appl. No.: 349,224

[22] Filed: May 9, 1989

Related U.S. Application Data

[63] Continuation-in-part of Ser. No. 164,010, Mar. 4, 1988, Pat. No. 4,856,566.

[51] Int. Cl.[5] ..... B65B 3/04

[52] U.S. Cl. ..... 141/1; 141/142; 141/144; 141/168; 141/148; 141/248; 141/179; 53/168

[58] Field of Search ..... 141/140, 141, 142, 143, 141/163, 168, 134, 135, 156, 138, 177, 129, 144, 145, 170, 234, 248, 237, 179, 133, 181, 182, 152, 148.1; 33/168, 251; 198/481.1, 861.6, 507

[56] References Cited

U.S. PATENT DOCUMENTS

| | | | |
|---|---|---|---|
| 1,893,831 | 1/1933 | Weber | 141/133 |
| 3,152,622 | 10/1964 | Rothermel | 141/179 |
| 3,330,310 | 7/1967 | Heffelfinger | 141/248 |
| 3,410,377 | 11/1968 | Riedel et al. | 141/152 |
| 3,554,412 | 1/1971 | Hayashi et al. | 141/144 |
| 3,967,659 | 7/1976 | Warner et al. | 141/148 |
| 3,967,662 | 7/1976 | Warner | 141/148 |
| 4,122,876 | 10/1978 | Nalbach | 141/152 |
| 4,585,040 | 4/1986 | Cramer | 141/248 |
| 4,757,891 | 7/1988 | Krumpe et al. | 198/481.1 |
| 4,915,146 | 4/1990 | Warner | 141/144 |

*Primary Examiner*—Ernest G. Cusick

*Attorney, Agent, or Firm*—Laff, Whitesel, Conte & Saret

[57] ABSTRACT

The invention greatly increases the versatility and the speed at which an automatic packaging machine may fill boxes or other containers. Two fill stations are provided for alternately filling empty boxes as they move in single file past two separate fill stations. If no empty box is available to receive the product, a transfer cup is diverted and travels over one of two alternate paths at the fill station would otherwise fill the missing box. The product dumped from any non-diverted transfer cup goes into a corresponding box. The product dumped from any diverted transfer cup is returned to the start of the fill cycle. This way, the machine may simultaneously (i) fill one box with two separate products, (ii) fill alternate boxes with two different products or product volumes, or (iii) fill different kinds of boxes with product. A swing arm enables a part to be moved at each of the fill stations so that it may be repaired, maintained or cleaned without having to disassemble the machine. The resulting machine not only acts much faster, but also is able to simultaneously handle different products, and boxes in many different ways.

28 Claims, 10 Drawing Sheets

FAST ACTING DOUBLE LOADING SYSTEM FOR AUTOMATIC PACKAGING MACHINE

This is a continuation-in-part of Ser. No. 07/164,010, filed Mar. 4, 1988 now U.S. Pat. No. 4,856,566, issued Aug. 15, 1989.

This invention relates to loading stations for automatic packaging machines and more particularly to fast acting loading stations with greatly reduced wear.

As used herein the terms "box" or "boxes" are broad enough to cover any suitable containers such as bottles, cups, bags, or the like.

Automatic packaging machines usually have a magazine filled with cardboard blanks which are picked up, one at a time, by vacuum cups, formed into boxes, and inserted into individual mandrels. The mandrels are carried by an endless link chain which circles a table. As the mandrels pass various work stations, the boxes are filled with product, closed, sealed, and discharged. The mandrels circle back to receive the next empty boxes, after the filled boxes are discharged.

A common problem is that occasionally a box either is missing or is not properly inserted into a mandrel. Then, it becomes necessary to detect the empty or improperly filled mandrel and to abort the fill cycle when that particular mandrel appears at the fill station. Otherwise, the product would be dumped through the empty mandrel and, perhaps, onto whatever is beneath it. Aside from any damage caused by the product falling into machinery, if the product may spoil, as with a food, the resulting unsanitary condition would be intolerable.

Heretofore, automatic packaging machines have included a series of measuring cups for carrying product to boxes at a fill station. A detector detected the presence of each box as its associated measuring cup approaches a mandrel. If the box is present, a gate in the bottom of the measuring cup is opened to dump the contents of the cup into the box. The gate is not opened if the box is missing. The operation of a gate on each fill cycle requires some finite time which inherently limits the speed of the packaging machine. The continuous operation of a gate on each and every fill cycle imposes substantial wear and, therefore, a high maintenance cost.

Accordingly, a loading machine shown in the parent application Ser. No. 07/164,010, filed Mar. 4, 1988 now U.S. Pat. No. 4,856,566 entitled "Fast Action Loading System For Automatic Packaging Machine" eliminates the gate on the bottom of the measuring cup. That machine greatly increased the loading speed of the machine; however, it was not as versatile as it could be. As fast as it was, its speed could be increased for a simple loading of a single product. Also, sometimes more is required than a simple loading of a single product. For example, sometimes two products are loaded into a box having two compartments with one product in one compartment and another product in another compartment, as for example when instant coffee is put in one compartment and powdered milk in another compartment.

On another occasion, perhaps the same product is sold under two different private brands. For example, two grocery or drug store chains may sell the same aspirin under their own house labels. Then, the same product must be loaded into two different boxes having two different graphics.

Yet another example is where different weights or volumes of the same product may be loaded. For example, 24 aspirin tablets may be put into one box and 100 of the same aspirin tablets may be put into another box.

For these and many other reasons, it is desirable to provide an automatic loading machine having not only a faster operation, but also a versatility which is greater than the versatility of the machine shown and described in the parent application.

Therefore, an object of the invention is to provide new and improved automatic packaging machines with a greatly increased fill speed. In this connection, an object is to enable such packaging machines to load more than one product at a time. In particular, an object is to load product in a combination of different weights, graphics, multicomponents boxes, and the like. Here, an object is to provide packaging machines which do not require gates for transferring product from a cup to a box.

Another object is to provide automatic packaging machines which can recover a plurality of products that is not dumped into boxes.

Still another object of the invention is to provide wear resistant moving parts at a plurality of fill stations.

Yet another object of the invention is to provide automatic packaging machines which may be changed over quickly and easily when it is necessary to change the volume of product which is placed in either of two or more boxes.

In keeping with an aspect of the invention, these and other objects are accomplished by providing two or more fill stations, each with an endlessly circling series of bottomless transfer cups, each cup being made of a highly wear resistant material, such as molded nylon. These cups slide along a first wear resistant surface which functions as the bottom of the cups, to retain any product therein. A series of box carrying mandrels move under the first surface, in synchronism and alignment with the transfer cups at each of the two fill stations.

At a given location in each of the two fill stations, the first surface has a first interruption so that any product within the transfer cup falls into a box carried by the mandrel. If an empty mandrel is detected, the transfer cup is deflected from its normal path so that it does not pass over the first interruption, which prevents the product from falling out of the cup. Instead, the deflected transfer cup passes over a second interruption in the surface through which the product falls, to enter a recovery bin. A number of bottomless measuring cups are positioned in a merry-go-round which is above the transfer cups in order to deposit a predetermined volume of product in each transfer cup, when the measuring cup encounters a second interruption in a second surface that functions as the bottom of the measuring cup. To change the volume of product deposited in each box, the measuring cups may be replaced quickly and easily, without requiring any substantial amount of work for disassembly and reassembly of the packaging machines.

Since there are a plurality of fill stations, a different product, weight, or the like may be deposited in a box at each station. The conveyor carrying the boxes to and from the fill station move in a single file which passes each station so that it may deposit product in different ways. Every other box is filled in one station, and alternate boxes are filled in the other station.

A preferred embodiment of the invention is shown in the attached drawings, in which.

Figure 1A:
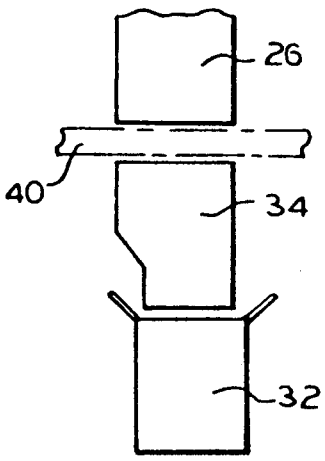
FIG. 1A is a cross section of FIG. 1 showing the relative vertical positions of the various surfaces and parts.
Figure 1:
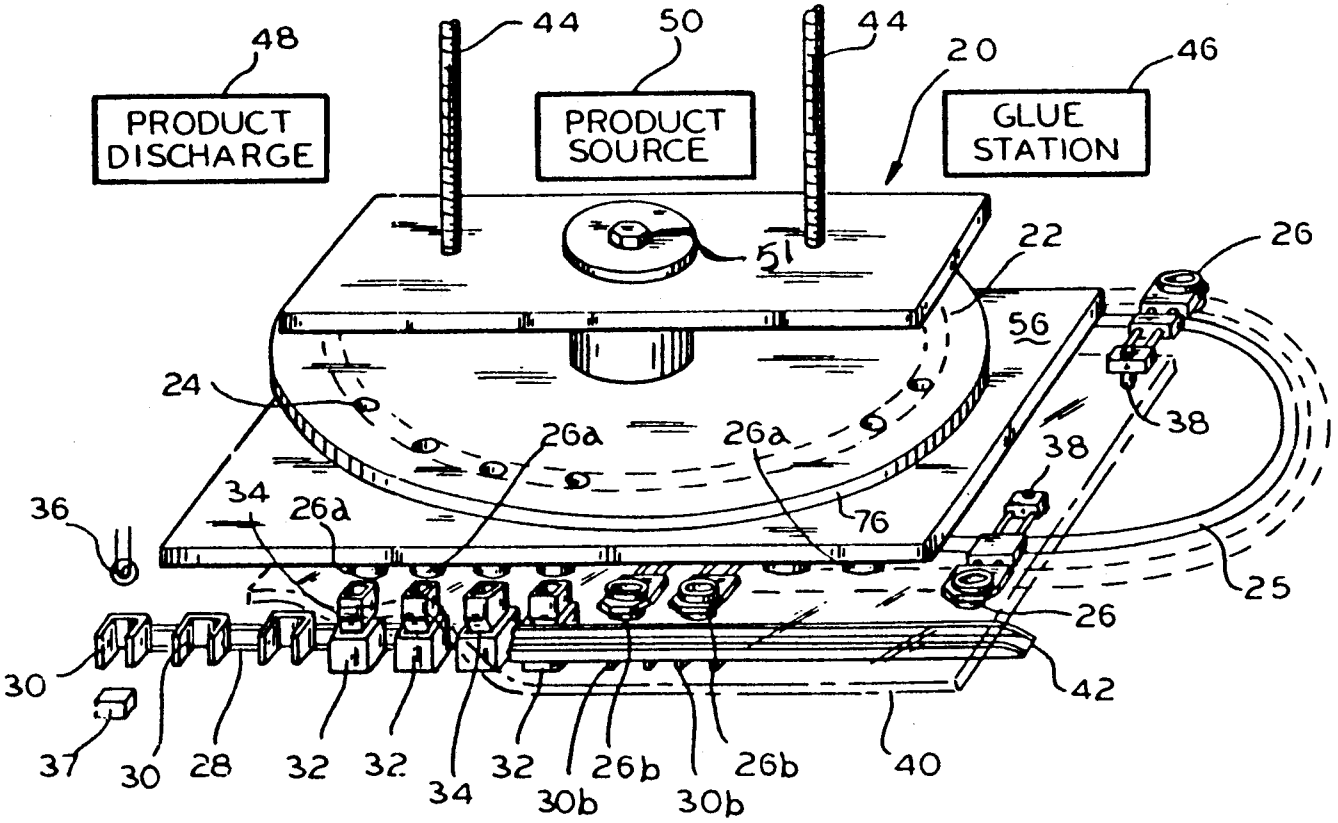
FIG. 1 is a perspective view of the inventive automatic packaging machine which is shown and described in the parent application Ser. No. 07/164,010.
Figure 2:
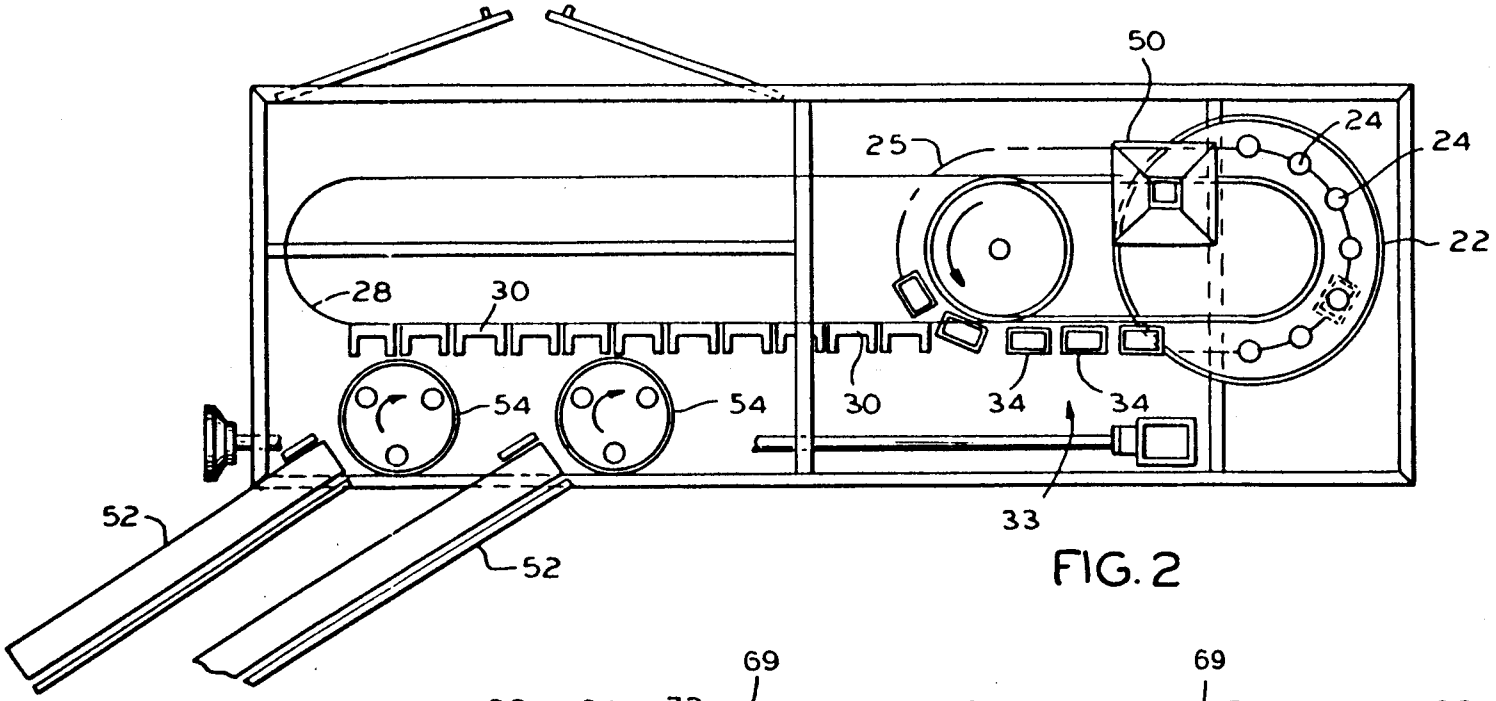
FIG. 2 is a plan view looking down on the top of the machine of FIG. 1.

FIGS. 1 and 2 disclose the automatic packaging machine, which incorporates the invention shown and described in parent application Ser. No. 07/164,010. A superstructure 20 raises and lowers a conveyor in the form of a merry-go-round 22 for carrying a number of bottomless volumetric or measuring cups 24. An endless conveyor 25 carries a number of bottomless, wear resistant transfer cups 26 which travel under and in alignment with the measuring cups 24. A conveyor chain 28 carries a number of mandrels 30 for transporting boxes 32 past a fill station 33, in alignment with the traveling transfer cups 26. A number of funnels or chutes 34 are carried by the conveyor 25 to guide and direct product falling from bottomless transfer cups 26 into boxes 32.

Any suitable sensor 36, 37 detects the presence of a mandrel 30 which does not have a box 32 in it. While any suitable sensor may be used, FIG. 1 shows a lamp 36 and a photocell detector 37 positioned so that a box in a mandrel interrupts the light of lamp 36 falling on the detector. When a box is missing, a cam pin 38 is pushed down at a transfer cup position which will be in alignment with the empty mandrel 30, as it passes through the fill station. If the cam pin 38 is not pushed down, the bottomless transfer cups remain aligned (as shown at 26*a*) with the mandrels 30 and the boxes 32 which they contain. However, if the cam pin 38 is pushed down, the transfer cup moves outwardly, as shown at positions 26*b*, while it is traveling over empty mandrels 30*b*. When the transfer cup does not move out, it dumps product into a box 30. When transfer cup does move out, it does not dump into the box.

Each of the bottomless transfer cups 26 slides over a wear resistant surface 40 shown here in phantom lines (see FIG. 1A), the surface functioning somewhat as the bottom of the transfer cup to keep the product in it. When a transfer cup is traveling in its normal path over an empty box, it encounters an interruption in the surface 40 so that the product falls from the transfer cup and into the box. However, if the transfer cup is pushed out (as at 26*b*), it does not pass over the interruption in surface 40 at a point where the product may pass into a box 32. Instead, the pushed out cup 26*b* passes over a second interruption in surface 40 which causes the product to drop into a discharge chute 42 from which it may be reclaimed and recycled to measuring cup 24.

The remaining parts of FIG. 1 are jack screws 44, 44 which may raise or lower the merry-go-round 22 to accommodate various sizes of measuring cups. A glue station 46 seals the boxes after they are filled. Any suitable product discharge device 48, such as a conveyor, may pick up the boxes after they are filled and sealed. A product source may be provided in the form of a suitable funnel, chute, or the like, 50 for filling the measuring cups 24 on the merry-go-round 22. A nut 51 may be removed to disassemble the feed mechanism for cleaning, repair or maintenance.

FIG. 2 looks down on the top of FIG. 1 and shows two magazines 52, 52 for storing blanks which are picked up by suction cup feeders 54, 54 that press the blanks into the mandrels 30, forming them into boxes, in the process.

The details of the inventive machine are shown in the remainder of the drawings (FIGS. 3–7).

Figure 3C:
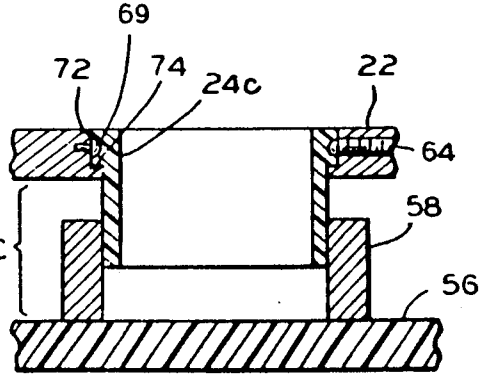
FIGS. 3A–3C are cross-sectional views of three different sizes of measuring cups, which illustrate how the measured volume of product may be changed.
Figure 3B:
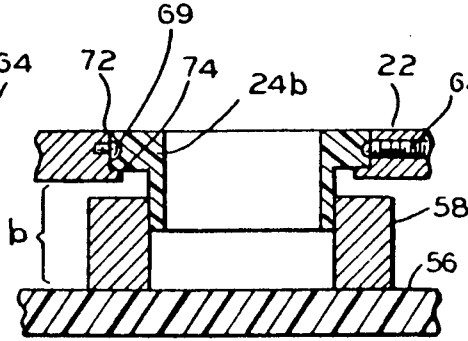
Figure 3A:
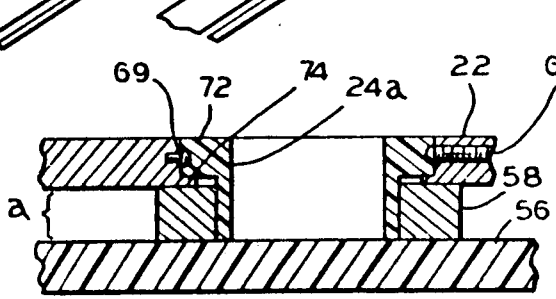

In greater detail, FIGS. 3A–3C show three different and exemplary sizes of measuring cups which are here shown as having volumes approximately in the order of 1, 1.5, and 3.5 oz, respectively. It will be noted that each measuring cup 24 is a bottomless cup which slides along a surface 56, which functions as the bottom for containing the product therein. An interruption in the surface of transfer plate 56 allows the product to fall from measuring cup 24 and into an underlying box.

Each of the measuring cups 24 has the same diameter so that all sizes may be loaded in the same holes in merry-go-round 22; therefore, the distances a, b, c between the merry-go-round and the surface of transfer plate 56 are different for each cup. The jack screws 44, 44 (FIG. 1) are driven to lift or lower the merry-go-round to the proper height a, b, c for the cups when they are put into current use. Preferably, the heights are programmed into a control system for driving the jack screws 44, 44 so that a worker only has to set an identification of a cup size. A free and telescoping ring 58 surrounds cups 24 and slides over the surface of transfer plate 56. Since the ring 58 is free to slide up and down or to tip slightly, and since the ring rests under gravity against surface 56, any small unevenness in the surface 56 is accommodated.

Each cup 24 (FIG. 4) has a collar 60 with a circumferential groove 62 for receiving a set screw 64. A skirt 66 depends from the collar for receiving and moving the ring 58 (FIG. 3). One side of the collar has an indentation or cut out part 68 which enables it to slip over a detente 69 which projects from the inside wall of a hole 70.

The merry-go-round 22 has a series of holes 70 arranged in a circle which is concentric to the periphery and centered on the axis about which merry-go-round turns. Each hole has a sidewall 72 shaped and sized to receive collar 60, with an accurate fit. A ledge 74 extends inwardly from the bottom of sidewall 72 to provide a seat on which the collar 60 may rest. The peripheral or outside circumferential wall 76 of the merry-go-round 22 is fairly close to the hole 70 so that set screw 64 may be loosened or tightened from a convenient location at the front of the merry-go-round. Index markings 78, 80 are provided on the surface of the merry-go-round 22 and on the top of measuring cup 24. When these marks are aligned and the measuring cup 24 is dropped into the hole 70, the indentation 68 passes over the detente 69. A ring 58 (FIG. 3) is positioned on top of surface 56 and in a location for skirt 66 of cup 24 to pass through. The underside of collar 60 sets within hole 70 and on ledge 74. The cup 24 is rotated so that detente 69 is captured within groove 62. Then, the set screw 64 is tightened to lock cup 24 in place.

To change the size of the measuring cup, each set screw 64 is loosened. Each cup 24 is rotated until marks 78, 80 are in alignment. Then, the cup may be lifted from hole 70 with the indentation 68 passing over detente 69. The jack screws 44, 44 (FIG. 1) are driven to move the merry-go-round 22 up or down to a proper distance a, b, c from the surface 56. A ring 58 (FIG. 3) having a proper height is set on top of surface 56 and under hole 70. A new size of measuring cup 24 is passed through hole 70 and ring 56, and then rotated to capture detente 69. Next, the set screw 64 is tightened.

Figure 7:
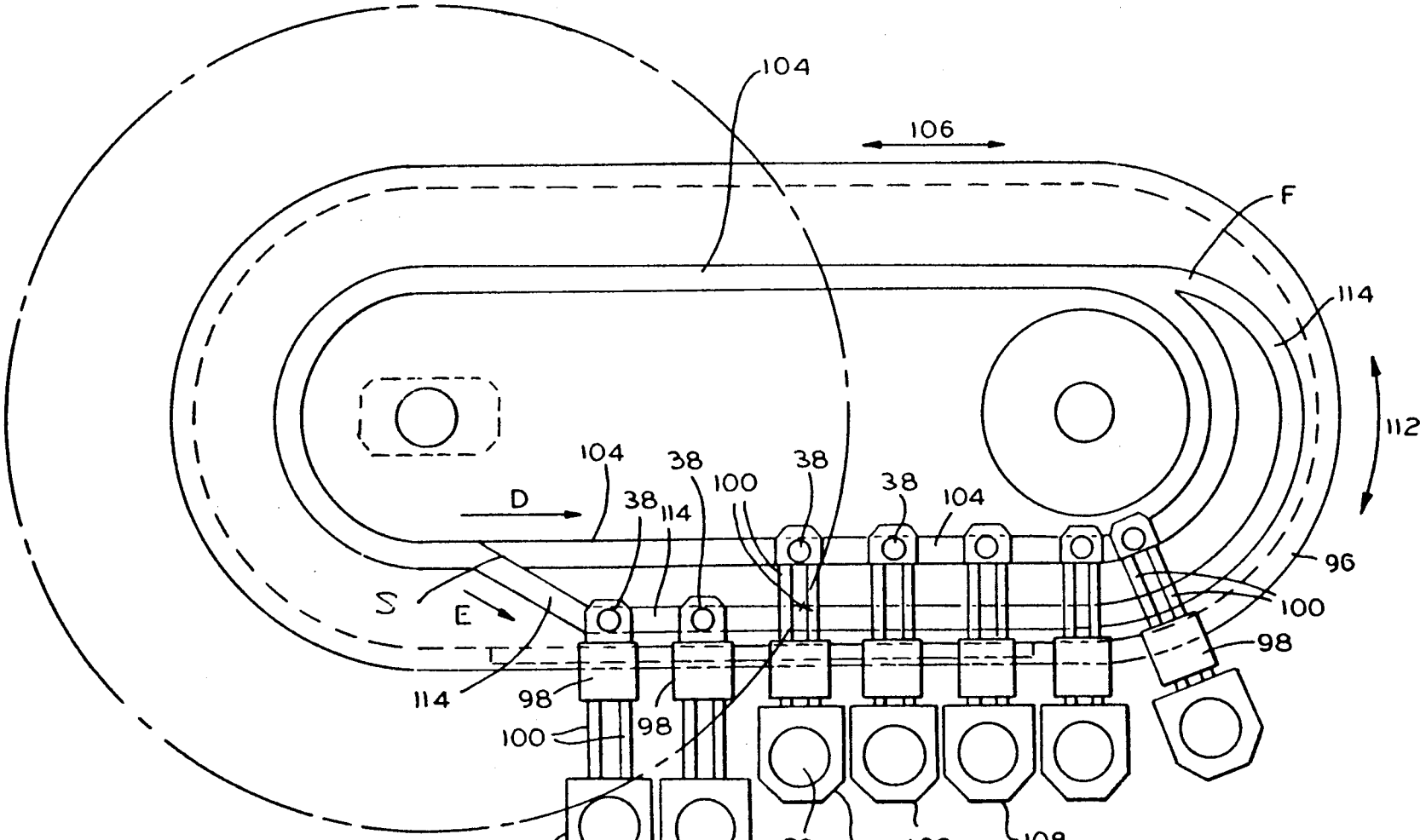
FIG. 7 is a plan view of a cam slot system for deflecting or not deflecting transfer cups under control of the cam pin and depending upon whether a box is or is not present.
Figure 4:
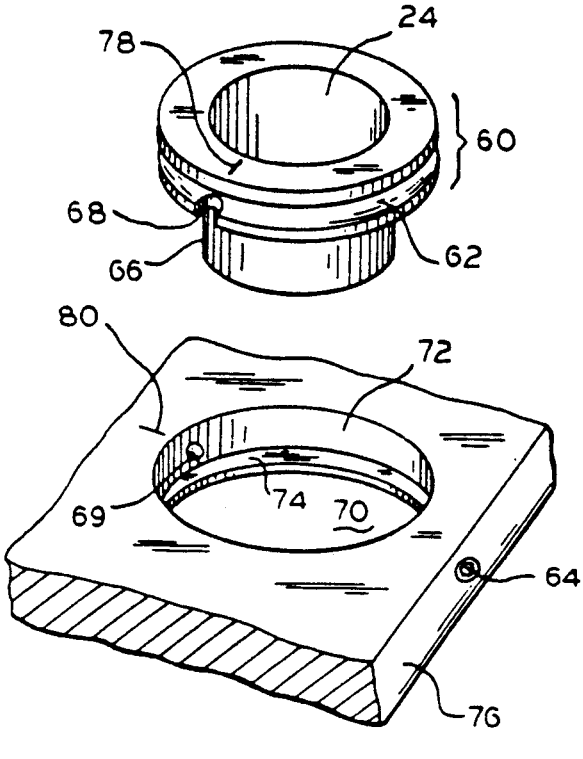
FIG. 4 is a perspective view of one of the measuring cups of FIGS. 3A–3C.
Figure 5:
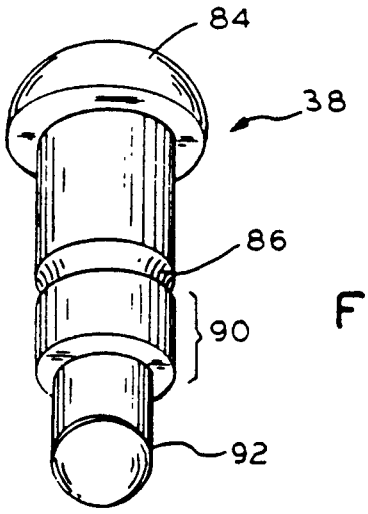
FIG. 5 is a perspective view of a cam pin used for deflecting the transfer cup when a box is not in a mandrel.
Figure 6A:
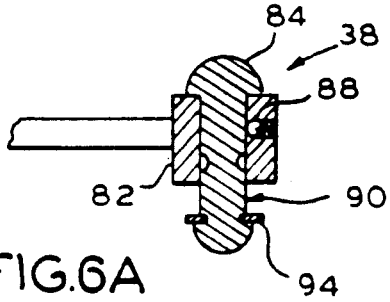
FIG. 6A is a fragment of FIG. 6 with the cam pin in a lowered position.
Figure 6:
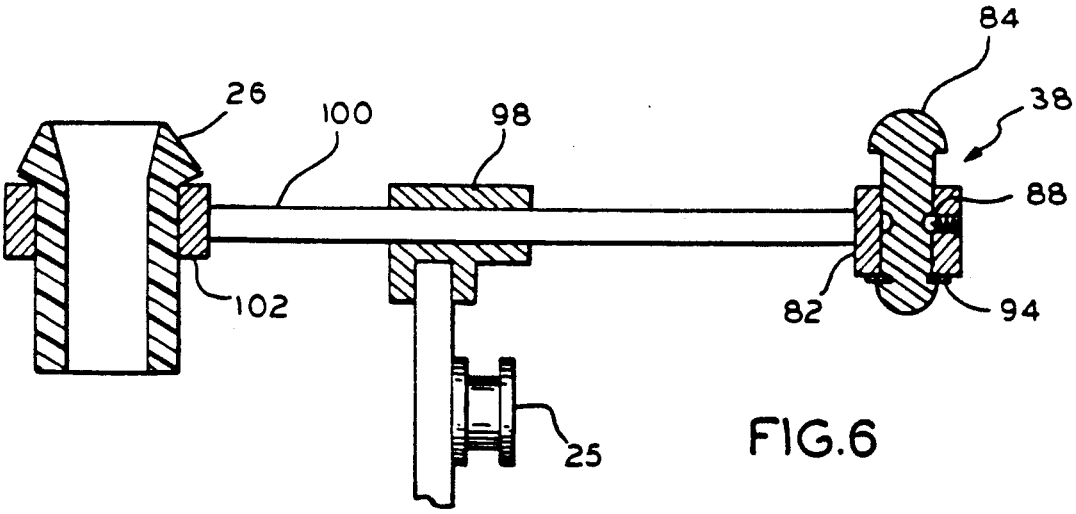
FIG. 6 is a transfer cup slide assembly controlled by the cam pin of FIG. 5, with the cam pin in an elevated position.

FIGS. 5, 6, 7 show how a transfer cup 26 is deflected to avoid dumping product through a mandrel which does not contain a box. In greater detail, FIG. 5 shows a cam pin 38 with a two level cam which is carried by a holder block 82 (FIG. 6). The top 84 of the cam pin 38 is a dome which may or may not encounter a downward deflecting surface depending upon the presence or absence of a box 32 (FIG. 1) within a mandrel. A groove 86 normally receives a spring loaded detent 88 in holder block 82 which normally holds the cam pin 38 in an elevated position, as seen in FIG. 6. If pin 38 is lowered (FIG. 6A), a cam surface 90 on it guides the transfer cup 26 to a deflected position. In the raised position shown in FIG. 6, the cam surface 90 is substantially within holder block 82 where it cannot deflect the transfer cup. A groove 92 (FIG. 5) receives and holds a retainer ring 94 (FIG. 6) which keeps the cam pin 38 from being removed from the holder block 82.

Figure 8:
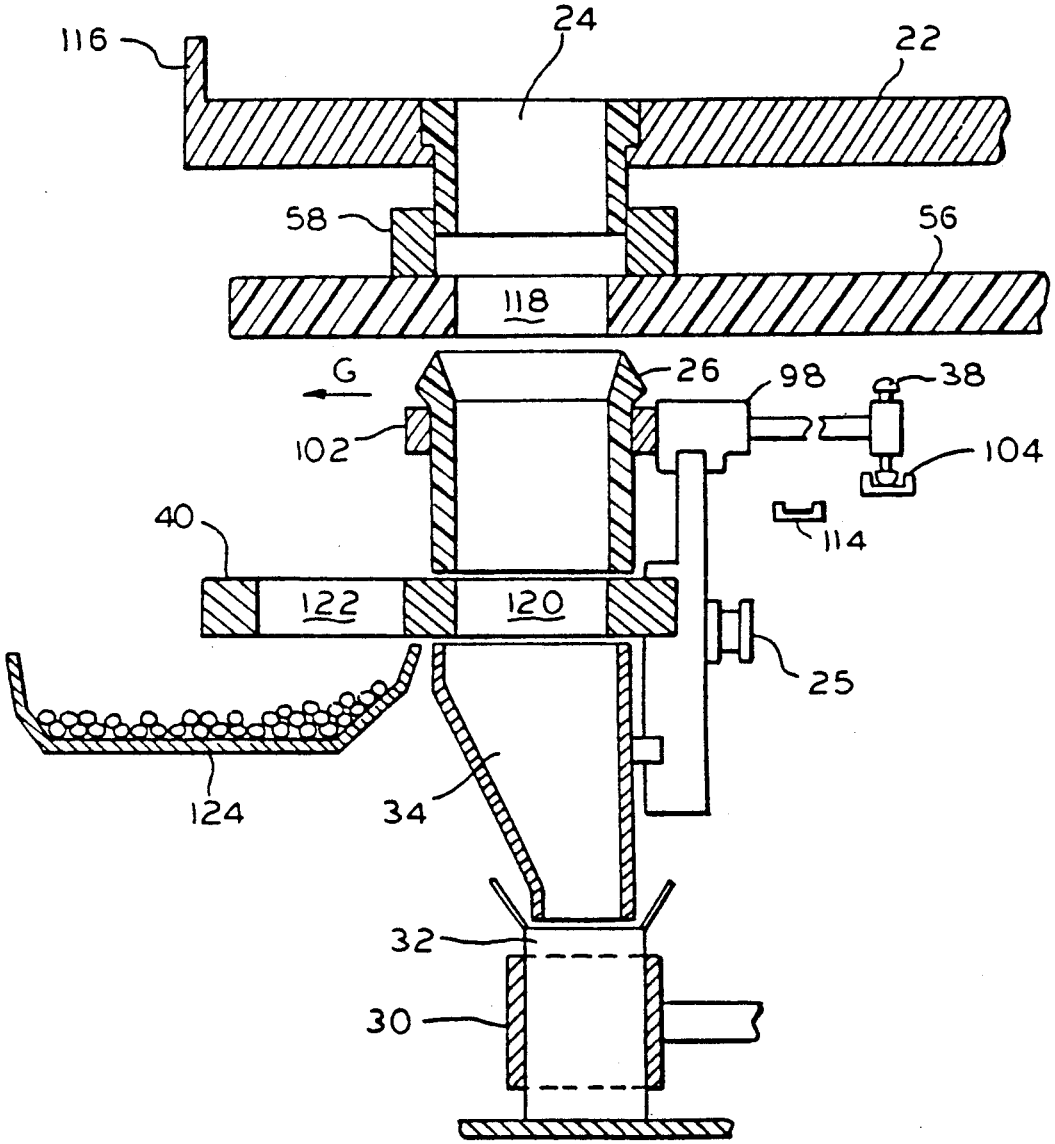
FIG. 8 is a stylized cross-sectional view of a fill station showing the principles of this invention.

The transfer cup 26 and its holder assembly are best seen in FIG. 6. A link chain 25 circles the fill station 33 (FIG. 2) and has a slide bearing 98 attached thereto in order to carry the transfer cups 26 over a path (FIG. 2) above the conveyor 28 of the boxes. Conveyor 25 also carries fill funnels or chutes 34 (FIGS. 1, 8). During part of this path, the link chain 25 normally holds transfer cups 26 under the holes 70 in merry-go-round 22 and over the fill funnels or chutes 34 and boxes 32.

A pair of rods 100 extend from cam pin holder block 82 through slide bearings 98 to a transfer cup holder 102. When cam pin 38 is elevated, it follows a first path which pulls the rods 100 to the right as viewed in FIG. 6, in order to move transfer cup 26 over the boxes. When cam pin 38 is pushed down, cam surface 90 pushes rods 100 to the left which slide through bearing 9 to deflect the transfer cup 26 to a position where it cannot fill a box.

The arrangement for accomplishing this deflection of transfer cup function is seen in FIG. 7 which has a cam slot 104 arranged in a race track pattern, that follows and parallels the link chain conveyor 25. The cam pins 38 are selectively pushed down by any suitable means in the area 106, responsive to a box missing signal from sensor 37 (FIG. 1). The particular cam pin which is so pushed down is the one which is associated with a transfer cup which will be directly over the particular mandrel with a missing box that prompted the signal from sensor 37, when that mandrel is in a position to receive product. When the cam pins 38 are in the elevated position (FIG. 6), the lower tip end follows path D (FIG. 7), which pulls rods 100 to position transfer cup holder 102 over the path followed by the mandrels 30 and boxes 32 (FIG. 1), as shown at 108. On the other hand, if the cam pin 38 is pushed down (FIG. 6A), the cam surface 90 is deflected to path E (FIG. 7) and cam slot 114. This pushes the transfer cup holder 102 outwardly (as shown at 110) where the transfer cup cannot drop product into the non-existing box 32 or the empty mandrel 30.

Figure 7A:
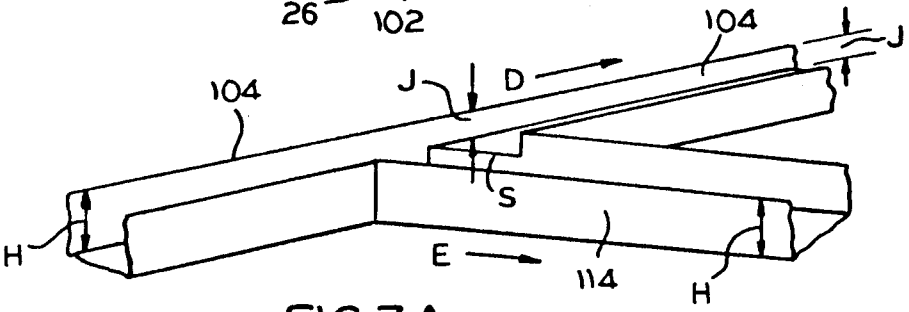
FIG. 7A shows a part of a cam track which is also seen in FIG. 7.

FIG. 7A shows, in perspective, the structure of grooves 104, 114 (FIG. 7). The left hand end of groove or track 104 has a depth H, which is continued into groove or track 114. At the junction of tracks 104, 114, there is a step S in the bottom of track 104, after which track 104 has a depth J. If the pin 38 is down, the step S guides the pin into track 114 (path E). If the pin 38 is up, it passes over step S and, since there is nothing to deflect the pin, it goes straight (path D).

In the area 112, the bottom of the cam slot 114 raises the cam pin 38 so that by the time that cam slot 114 rejoins cam slot 104 at F, all cam pins 38 are in their normal raised position (as shown in FIG. 6).

The equipment for carrying out the fill cycle is schematically shown in FIG. 8, where all parts are shown in a theoretical alignment, but it should be understood that the various alignments occur in a sequential cycle and at different physical locations. The merry-go-round 22 has a raised edge 116 which keeps the product from falling off the surface. The product falls onto the top of merry-go-round 22 and then into measuring cup 24, which carries it to a first interruption or suitable opening 118 in a transfer plate 56, where it falls into transfer cup 26. Preferably the first interruption or opening 118 is an elongated slot which enables measuring cup 24 to travel in alignment over open transfer cup 26 for a period of time which is adequate for the transfer of a full measure of the maximum amount of product for the largest measuring cup that can be used. After the measuring cup 24 leaves the first interruption, or opening 118, the product cannot be dropped from the measuring cup.

Likewise, the transfer cup 26 carries the product until it comes to a second interruption or opening 120 in surface 40, at which time the product falls through chute 34 and into box 32 which is being carried by mandrel 30. Again the second interruption or surface opening 120 is a slot which is long enough to insure a complete transfer of the maximum amount of product that can be handled by the machine (i.e., the largest box which this machine can carry).

It should be understood that FIG. 8 shows openings 118 and 120 aligned, but that is only for convenience of explanation. In reality these two openings are displaced from each other by a substantial distance so that there is a three-step transfer operation (a) from measuring cup 24 through first interruption or surface opening 118 to transfer cup 26, (b) ample time to displace the transfer cup 26 in direction G if no box is present, and (c) from the transfer cup 26 to box 32 via second interruption or surface opening 120 after there has been enough time to displace cup 26, if it is to be displaced.

FIG. 8 shows the cam pin 38 following cam slot 104 so that the product is deposited through surface interruption 120 and into the box 32. However, if cam pin 38 is following cam slot 114, the transfer cup holder 102 is displaced in direction G by a distance which is far enough for the transfer cup 26 to pass over a third surface interruption 122 instead of over the second interruption 120. When transfer cup 26 passes over surface interruption 122, the product falls there through and into a collection bin 124. Any suitable means, not shown, collects the product in bin 124 and returns it to the measuring cups 24.

Figure 9:
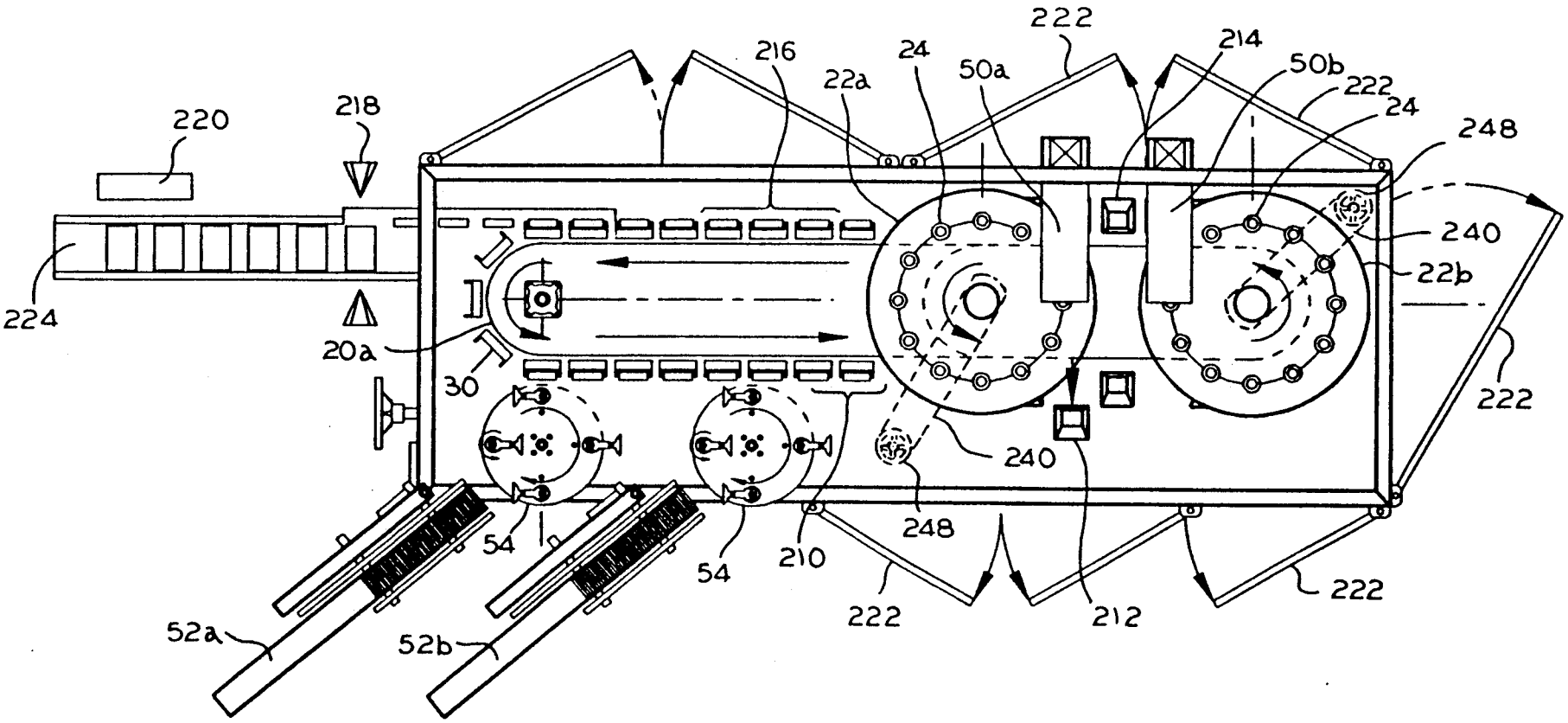
FIG. 9 is a top plan view of the inventive fast acting, double loading system for automatic packaging machines.
Figure 10:
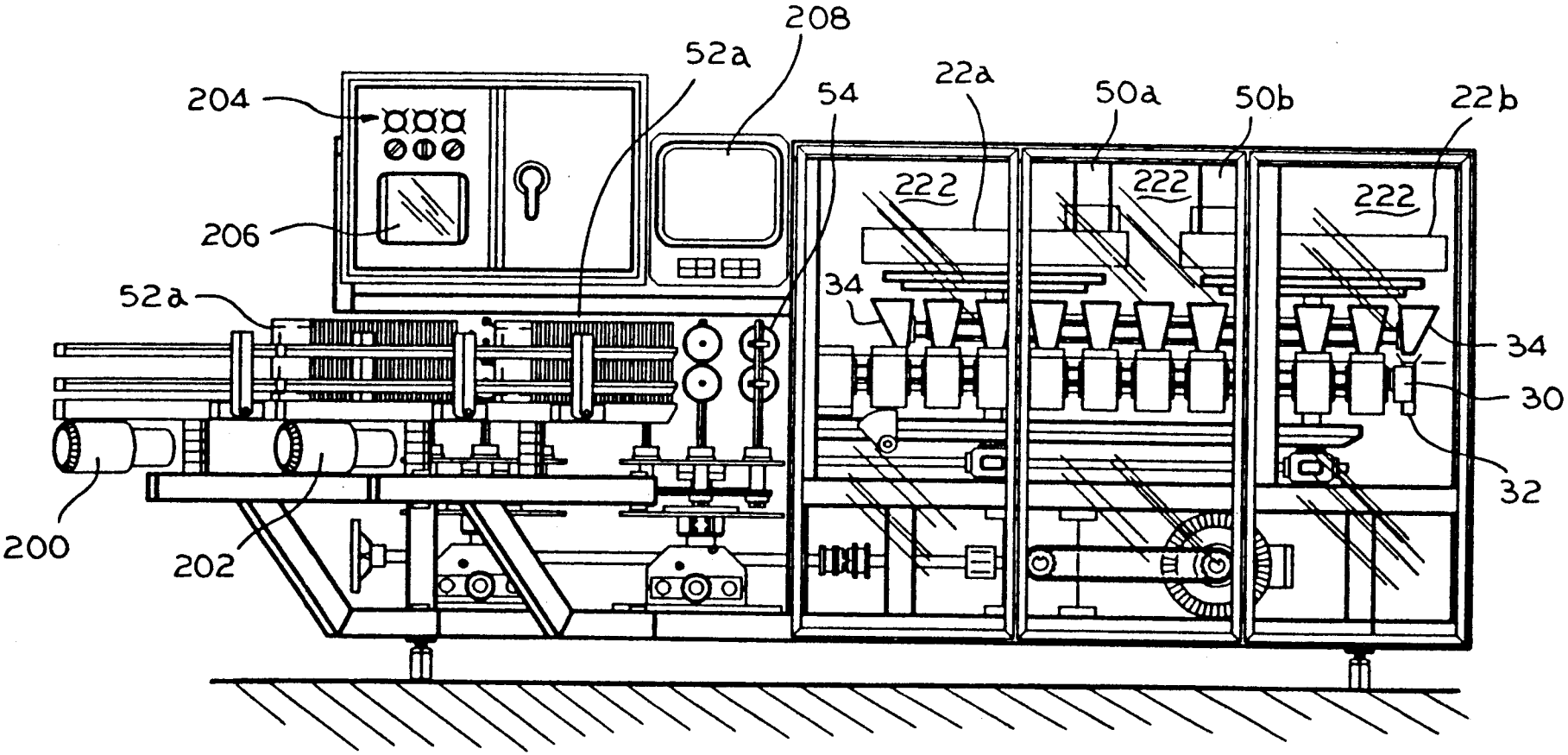
FIG. 10 is a side elevation of the machine of FIG. 9.

In order to provide for faster loading or for multiple loading, the embodiment of FIGS. 9, 10 may be used. The same reference numerals are used in FIGS. 9, 10 to identify parts which have already been described. Therefore, these parts will not be described a second time.

The merry-go-round is duplicated at 22*a*, 22*b* so that two fill stations are provided. If it should be desirable to do so, the machine may be stretched so that a third or fourth merry-go-round 22 may be added. Therefore, the invention is broad enough to cover any suitable number of merry-go-rounds.

The two magazines 52*a*, 52*b* provide for feeding cartons into the mandrels 30 from two separate sources. For example, cartons in magazine 52*a* could have one kind of graphics, or be for 24-tablets. The cartons in magazine 52*b* could have another kind of graphics or be for 100-tablets. In another case, the cartons may all be the same, but they may have two compartments for receiving two separate products. For example, dry milk could be loaded into a first compartment at merry-go-round 22*a* and instant coffee could be loaded into a second compartment of the same carton at merry-go-round 22*b*.

In any event, the conveyor 20*a* may be operated at approximately twice the normal speed of conveyor 20 in the single merry-go-round embodiment of FIGS. 1, 2. Therefore, for a single product, the output of the embodiment of FIGS. 9, 10 practically doubles the output of the single merry-go-round embodiment in FIGS. 1, 2.

Figure 11:
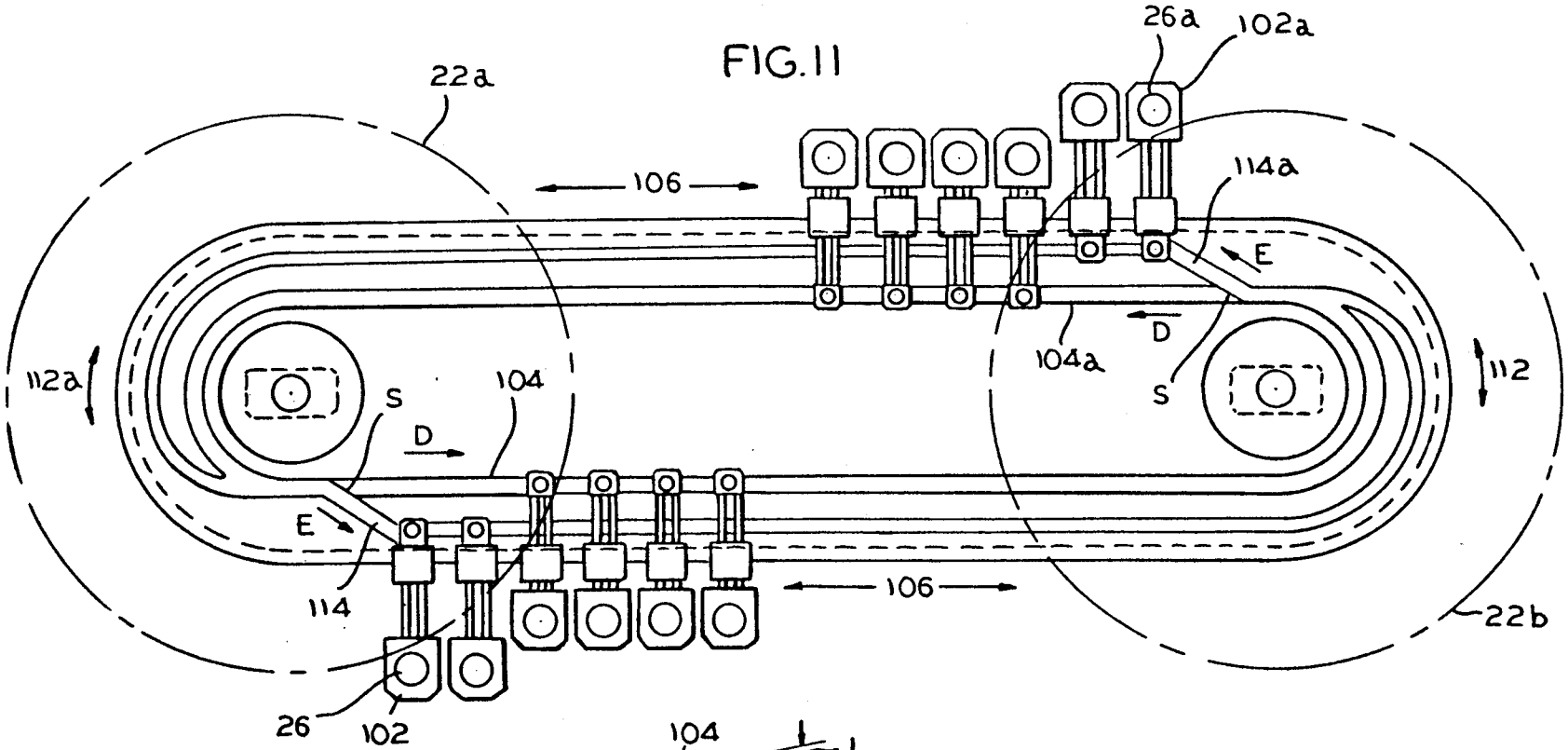
FIG. 11 is a plan view, similar to FIG. 7, showing the cam track for two fill stations.

FIG. 11 may be compared to FIG. 7 in order to learn more of the differences between the two embodiments In the single merry-go-round embodiment of FIG. 7, the diverting track 114 for the fill cups is on one side, the cam pins are set in the area 106, and reset in the area 112. In the two, merry-go-round embodiment of FIG. 9, the operation is the same with respect to the merry-go-round 22*a*. For the merry-go-round 22*b*, the functions are on the opposite sides of conveyor 20*a*. Thus, diverting track 114*a* is on the side opposite track 114. The cam pin set area 106*a* is opposite area 106. The cam pin reset area 112*a* is opposite area 112.

In operation, the box in every other mandrel is filled as it passes under the merry-go-round 22*a*. The alternate boxes which are unfilled at the first merry-go-round 22*a* are filled at the second merry-go-round 22*b*.

The remaining components which are seen in FIGS. 9, 10 are: carton magazine delivery motors 200, 202; controls 204; tachometer and totalizer display 206; a self diagnostic display 208; carton bottom closure area 210; product recovery chute 212 when there is no carton; a product transfer spout 214, carton top closure area 216; open flap detector and rejecter; date stamp 220; and filled carton discharge 224. A product recovery chute 212 for merry-go-round 22*b* is provided (but not visible) near the top of FIG. 2. Since food products are packaged, the entire unit is enclosed within glass doors 222 in order to preserve a sanitary condition.

In the FIG. 1 embodiment, the superstructure 20 includes two jack screws 44, attached to a plate, which in turn is coupled to the merry-go-round 22 by a nut 51 and threaded shaft. To repair, maintain, or clean the loading machine, some disassembly is required. This disassembly involved down time, which is expensive.

Therefore, in the second embodiment, each of the merry-go-rounds 22 (FIGS. 12, 13) is mounted on the end of a cantilever arm 240 attached to the lower end of an elevator mechanism 241 in the form of jack screw 242 (FIG. 14) enclosed in a telescoping sleeve 244 and held in place by a collar 246. A hand wheel 248 may be turned to raise or lower the merry-go-round 22. The hand wheel may be replaced by a drive motor, which may be computer controlled.

Figures 12, 13:
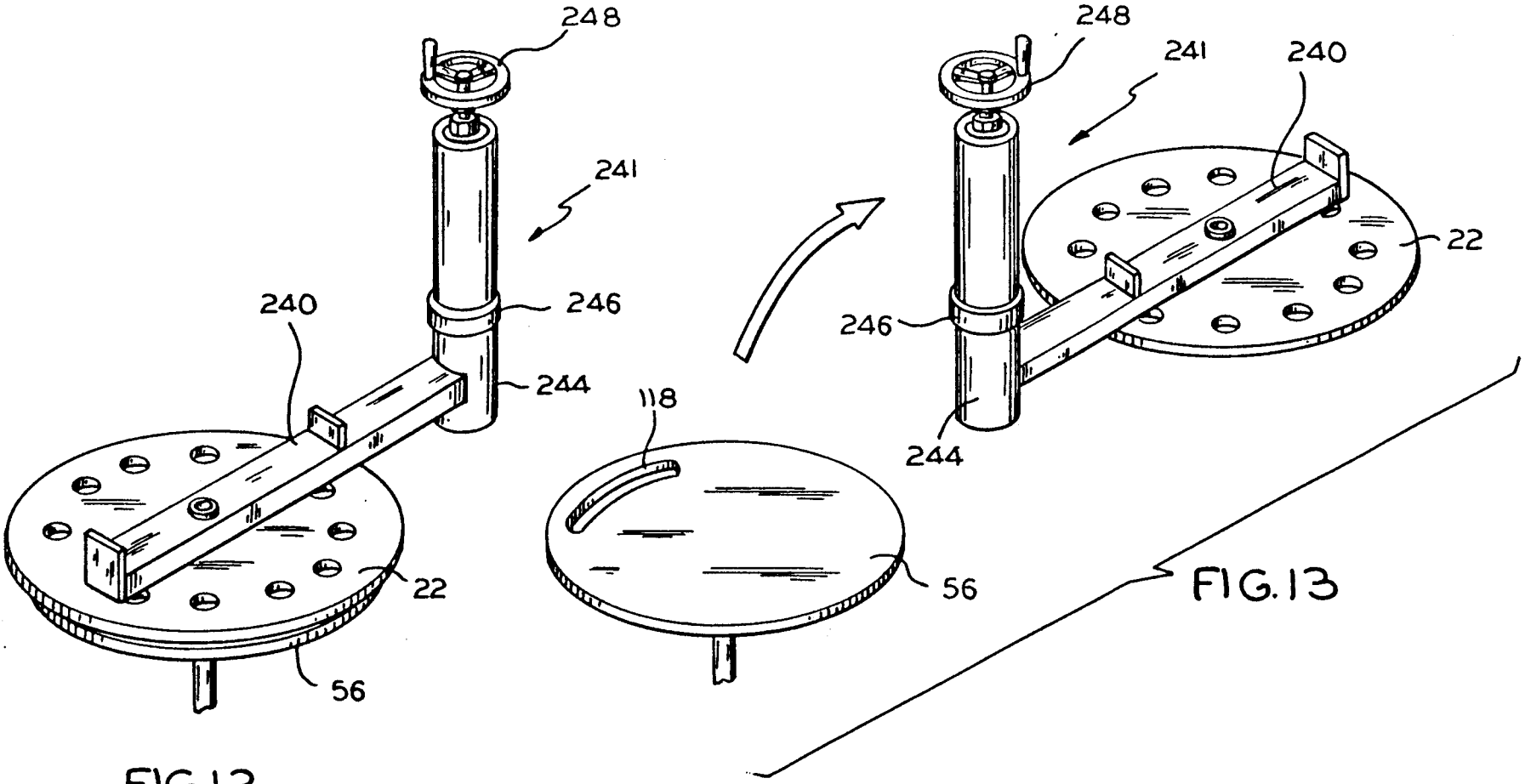
FIG. 12 is a fragment of FIG. 10 showing a support arm for a merry-go-round in an operate or fill position.
FIG. 13 is the same fragment of FIG. 10 showing the support arm moved to a maintenance position.
Figure 14:
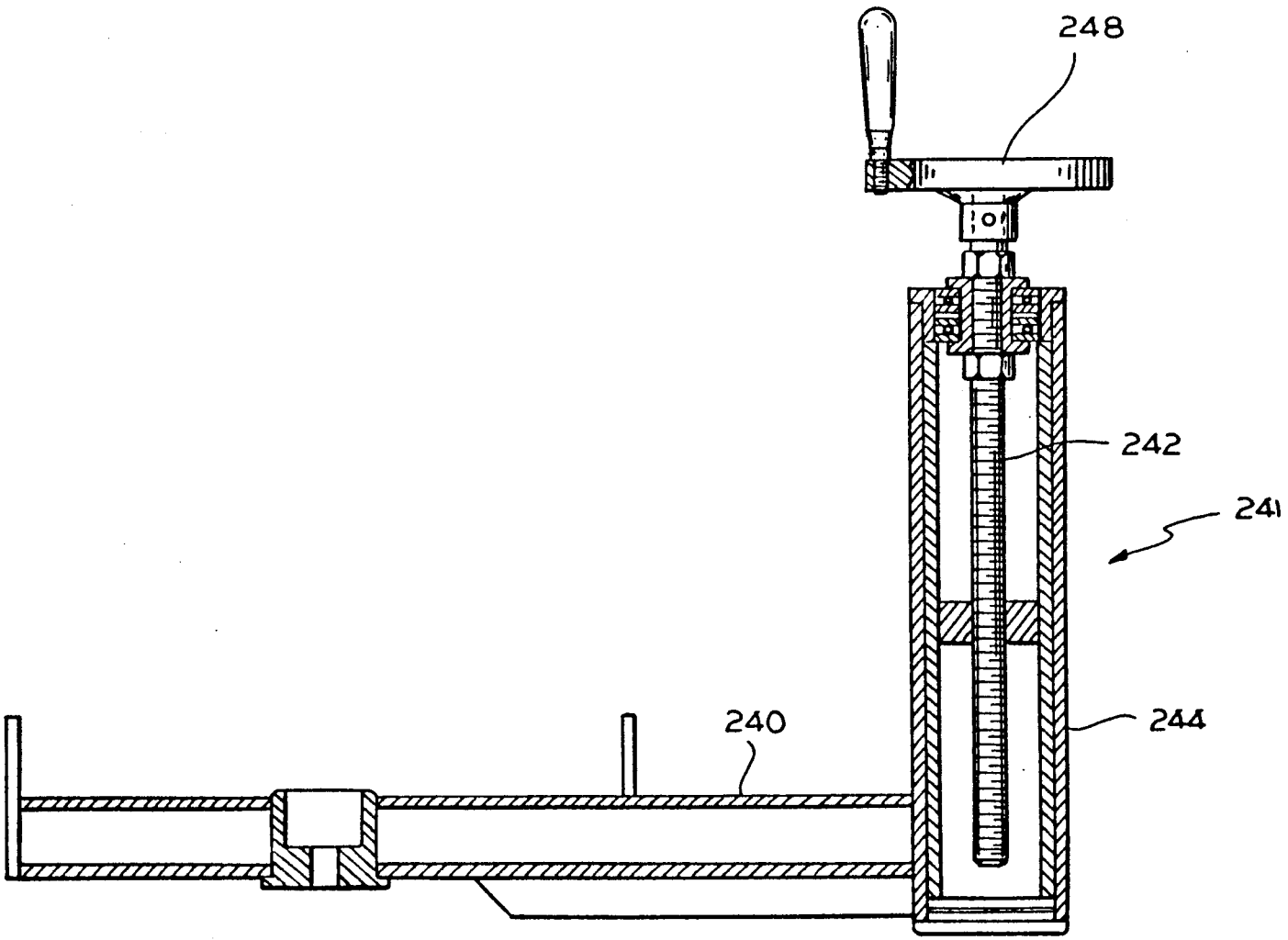
FIG. 14 is a cross section of the support arm of FIGS. 12 and 13.

When the merry-go-round 22 is in a lowered position, arm 240 is locked in the position seen in FIG. 12. The machine goes through the fill cycle which is described above. When the merry-go-round 22 is in a raised position, arm 240 is free to rotate. Therefore, an appropriate door 222 (FIGS. 9, 10) may be opened and the arm 240 may swing from the operating position of FIG. 12 to the maintenance position (FIG. 13). In this position, the machine may be cleaned, repaired, or maintained.

After the maintenance is completed, the arm 240 is swung back into the operating position, where the hand wheel 248 is turned to lower the merry-go-round 22 into the operating position.

Those who are skilled in the art will readily perceive how to modify the invention. Therefore, the appended claims are to be construed to cover all equivalent structures which fall within the true scope and spirit of the invention.

The invention claimed is:

1. An automatic packaging machine comprising a source of product, a plurality of transport means for successively moving measured volumes of product from said source toward a plurality of stations where each volume of said product is deposited in a box, a plurality of transfer means individually associated with each of said transport means also moving toward said stations in synchronism with said transport means for receiving said measured volumes of product during the moving thereof, conveyor means moving in synchronism with said transport and transfer means for presenting a sequence of empty boxes to said stations, said transfer means converging with said boxes at said stations for dumping product from said transfer means into at least some of said boxes at each of said stations, means for sensing an absence of a box in said sequence of empty boxes on said conveyor means, and means responsive to said sensing means for diverting a particular one of said transfer means at one of said stations corresponding to the position in said sequence of said absent box which would otherwise be filled at said one fill station, said diverting of said transfer means occurring before said absent box position reaches said one station in order to prevent said dumping of said product into the position in said sequence where said box is absent.

2. The machine of claim 1 wherein each of said transport means comprises a circular plate mounted to turn about an axis as a merry-go-round, a plurality of holes formed in said plate and centered on a circle which is concentric with said axis, and means comprising a swing arm for raising and lowering said circular plate and for swinging it between operating and maintenance positions.

3. The machine of claim 2 and means for adjusting an elevation of said plate when lowered in order to accommodate measuring cups of different depth.

4. The machine of claim 1 wherein said plurality of transfer means are located in a side by side relationship said conveyor moving along a way on one side of said side by side transfer means, around one of said transfer means, and back up the opposite side of said side by side transfer means; a plurality of transfer cup holders individually associated with each of said transfer means for traveling over a path with each transfer cup holder moving directly beneath a corresponding moving measured volume throughout at least part of said path which includes an opening through which said product passes into a box; said diverting means being responsive to said sensing means for displacing said transfer cup holder as it is moved; the displacing means being on said one side for one of said transfer means and being on said opposite side for the other of said transfer means.

5. The machine of claim 4 wherein said means for displacing said transfer means comprises a cam pin associated with a rod having a transfer cup thereon, a movement of said rod determining the displacement or non-displacement of said transfer cup holder, a cam slot for receiving said cam pin, said slot extending along the way followed by said conveyor means, said cam slot branching on each side of said way between a normal path and a displaced path, and means responsive to said sensing means for controlling said cam pin to cause it to follow a normal path through said slot or to selectively depart from said normal path and follow said displaced path at said branching on the side of said way where said absent box position would normally be filled, thereby forming said diverting means.

6. The machine of claim 5 wherein said cam pin comprises a two step cam pin having means for normally holding said cam pin on a first step, means responsive to said sensing means for moving said cam pin to a second step, said moving of said cam pin to said second step occurring before said cam pin reaches the branching cam slot on the side of said way where said absent box position would normally be filled, means responsive to said cam pin on said first step for following said normal path so that said transfer cup holder converges with one of said boxes, and means responsive to said cam pin on the second step for following said displaced path on the side of said way where said absent box position would normally be filled to divert said cup holder.

7. The machine of claim 6 and means responsive to said cam pin traveling in said cam slot over said displaced path and beyond said convergence for returning said cam pin to said normally held one step.

8. A method of transferring product through an automatic packaging machine for controllably loading at least two different products, said method comprising the steps of:

(a) simultaneously transporting a plurality of bottomless measuring cups, bottomless transfer cups, and boxes around closed paths which converge with each other in at least two different predetermined points along said paths;

(b) supporting products within said measuring cups and said transfer cups by individually associated underlying surfaces which are interrupted at predetermined locations to selectively allow product to fall in a two step operation out of said cups in order to transfer product from said measuring cups to said transfer cups and from said transfer cups to said boxes in at least said two predetermined points;

(c) detecting the presence or absence of any of said boxes as they move around said path; and (d) continuously moving said cups over said surfaces in coordination with movement of said boxes in order to produce a three step fill sequence at each of said predetermined points, said fill sequence comprising (i) transferring product from said measuring cups through one of said surface interruptions into said transfer cups, (ii) transferring product from said transfer cups through another of said surface interruptions into said boxes which are individually associated with said transfer cups; and (iii) selectively deflecting the path of one of said transfer cups responsive to the detection of an absence of a box in step (c), said selective deflection being effective at one of said two predetermined points where the absent box would otherwise be filled, so that product is not transferred from said transfer cup through said other interruption while it is in said deflected path.

9. The method of claim 8 and the added step of recovering product from said transfer cup in said deflected path.

10. The method of claim 9 and the added step of returning said deflected transfer cup from said deflected path to a normal path after recovery of said product from said deflected transfer cup.

11. An automatic packaging machine for handling at least two separate products, said packaging machine comprising transfer cups, two merry-go-rounds for picking up product from two different sources and for delivering said picked up product to said transfer cups, conveyor means for delivering empty boxes in a single file past said two merry-go-rounds for selectively receiving said product from the transfer cups, means for detecting an absent box in said single file, means for deflecting one of said transfer cups so that it cannot deliver product to said missing box, two swing arms each having one end mounted on the end of an elevating means, said merry-go-rounds being mounted on the opposite ends of said swing arms to move between operating positions and maintenance positions, and means responsive to said elevating means for individually raising and lowering said swing arms to either lock said merry-go-rounds in a product delivery position or free said merry-go-rounds to swing to said maintenance positions.

12. The machine of claim 11 wherein said two merry-go-rounds are in a side by side relationship, the conveyor for said single file of boxes extending along one side of said side by side merry-go-rounds, around one of said merry-go-rounds, and back along an opposite side of said side by side merry-go-rounds, means for delivering product to said boxes from one of said merry-go-rounds on said one side and from the other of said merry-go-rounds on said opposite side of said merry-go-rounds, whereby said two merry-go-rounds may fill boxes with two products, may fill boxes with different products, or may fill different kinds of boxes with product.

13. The machine of claim 12 wherein said transfer means are located adjacent said conveyor means, a plurality of measuring cups carried by said merry-go-rounds for said picking up of said product; a plurality of transfer cup holders individually associated with each of said transfer means for traveling over a path with each transfer cup holder moving directly beneath a corresponding measuring cup throughout at least part of said path which includes one opening through which said product passes into said transfer means and another opening through which said product passes into a box; said diverting means being responsive to an absence of a box for displacing said transfer cup holder as it is moved; the displacing means being on said one side for one of said merry-go-rounds and being on said opposite side for the other of said merry-go-rounds.

14. The machine of claim 13 wherein said means for displacing said transfer cup holder comprises a cam pin associated with a rod having a transfer cup holder mounted thereon, movement of said rod determining the displacement or non-displacement of said transfer cup holder, a cam slot for receiving said cam pin, said slot extending along a way which corresponds to a path followed by said conveyor means, said cam slot branching on each side of said way between a normal path and a displaced path, and sensing means for controlling said cam pin to cause it to follow a normal path through said slot or to selectively depart from said normal path and follow said displaced path at said branching on the side of said way where said absent box position would normally be filled, thereby forming said diverting means.

15. The machine of claim 14 wherein said cam pin comprises a two step cam pin having means for normally holding said cam pin on a first step, means responsive to said sensing means for moving said cam pin to a second step, said moving of said cam pin to said second step occurring before said cam pin reaches the branching cam slot on the side of said way where said absent box position would normally be filled, means responsive to said cam pin on said first step for following said normal path so that said transfer cup holder converges with one of said boxes, and means responsive to said cam pin on the second step for following said displaced path on the side of said way where said absent box position would normally be filled to divert said cup holder.

16. An automatic packaging machine comprising a source of product, at least one transport means for moving product units from said source toward at least one work station where each unit of said product is deposited in a box, said transport means comprising a circular plate mounted to turn about an axis as a merry-go-round, said merry-go-round carrying a plurality of telescoping cups for measuring product, a top half of each of said cups being firmly mounted on said merry-go-round, a bottom half of said cups being freely slidable on a surface, means comprising a swing arm for raising and lowering said circular plate and for swinging it between operating and maintenance positions, means for adjusting an elevation of said plate in order to adjust the volume of said cups and for accommodating different batch sizes of products, and conveyor means moving in synchronism with said transport means for presenting a sequence of empty boxes to receive said product from said transport means.

17. The machine of claim 16 wherein said means for raising and lowering said plate comprises a telescoping post whereby an elevation set or reset of said plate is accomplished by observing the relative positions of parts of said telescoping post.

18. The machine of claim 17 and a jackscrew for telescoping said post whereby an elevation set or reset of said plates is accomplished by observing and counting the rotations of said jackscrew so that said telescoping may be computer controlled.

19. The machine of claim 16 and means for mechanically coupling a movement of parts of said machine in order to maintain machine synchronization without regard to the position of said swing arm and plate, and means for operating said swing arm means without interrupting said machine synchronism.

20. An automatic packaging machine comprising a source of product, at least one transport means for moving product units from said source toward at least one work station where each unit of said product is deposited in a box, said transport means comprising a circular plate mounted to turn about an axis as a merry-go-round, means comprising a swing arm for raising and lowering said circular plate and for swinging it between operating and maintenance positions, conveyor means moving in synchronism with said transport means for presenting a sequence of empty boxes to receive said product from said transport means, said conveyor means for said boxes being located in a side by side relationship relative to said transport means, sensing means for observing said boxes on said conveyor means, and diverting means responsive to said sensing means for selectively displacing or not displacing a part as said transport means and said conveyor means are moved in order to prevent a deposition of a product unit in a location on said conveyor where a box is missing.

21. A machine having a plurality of moving parts which should be selectively controlled relative to their position as they move over a preselected path; a cam slot defining normal and diverted paths relative to the movement of said parts; a cam pin mounted to move with said parts, said cam pin having stable raised and lowered positions; said cam slot receiving, guiding, and directing said cam pin as it moves with said parts; sensing means; and means responsive to said sensing means for raising or lowering said cam pin depending upon a need to selectively control the machine relative to the path followed by said moving parts, said camp pin following said normal path through said cam slot when said pin is in one of said raised or lowered positions and selectively departing from said normal path to follow said diverted path through said cam slot when said pin is in the other of said positions; and means for causing said machine to perform different function depending upon the path followed by said pin.

22. The machine of claim 21 and means for normally holding said cam pin on a first step, means responsive to said sensing means for moving said cam pin to a second step, said moving of said cam pin to said second step occurring before said cam pin reaches a branching of said cam slot between said normal path and said diverted path, said branching being marked by different depths of said cam slot, means responsive to said cam pin on said first step for following said normal path through a cam slot of one depth, and means responsive to said cam pin on the second step for following said diverted path through a cam slot of a different depth.

23. The machine of claim 22 and means responsive to said cam pin traveling in said cam slot over said diverted path and beyond for returning said cam pin to said first step.

24. The machine of claim 23 wherein said means for returning said cam pin to said first step comprises a gradual change of said cam slot from said different depth to said one depth.

25. An automatic packaging machine comprising a source of product, a plurality of transport means for successively moving measured volumes of product from said source toward a plurality of stations where each volume of said product is deposited in a box, a plurality of transfer means individually associated with each of said transport means also moving toward said stations in synchronism with said transport means for receiving said measured volumes of product during the moving thereof, conveyor means moving in synchronism with said transport and transfer means for presenting a sequence of empty boxes to said stations, said transfer means converging with said boxes at said stations for dumping product from said transfer means into at least some of said boxes at each of said stations, means for sensing an absence of a box in said sequence of empty boxes on said conveyor means, means responsive to said sensing means for diverting a particular one of said transfer means at one of said stations corresponding to the position in said sequence of said absent box which would otherwise be filled at said one fill station, said diverting of said transfer means occurring before said absent box position reaches said one station in order to prevent said dumping of said product into the position in said sequence where said box is absent, said diverting means comprising a cam slot defining normal and diverted paths relative to the movement of said transfer means, a cam pin mounted to move with said transfer means, said cam pin having stable raised and lowered positions; said cam slot receiving, guiding, and directing said cam pin as it moves with said transfer means; and means responsive to said sensing means for raising or lowering said cam pin depending upon a need to selectively control the machine relative to the path followed by said transfer means, said cam pin following said normal path through said cam slot when said pin is in one of said raised or lowered positions and selectively departing from said normal path to follow said diverted path through said cam slot when said pin is in the other of said positions for said prevention of said dumping.

26. The machine of claim 25 and means for normally holding said cam pin on a first step, means responsive to said sensing means for moving said cam pin to a second step, said moving of said cam pin to said second step occurring before said cam pin reaches a branching of said cam slot between said normal path and said diverted path, said branching being marked by different depths of said cam slot, means responsive to said cam pin on said first step for following said normal path through a cam slot of one depth, and means responsive to said cam pin on the second step for following said diverted path through a cam slot of a different depth.

27. The machine of claim 26 and means responsive to said cam pin traveling in said cam slot over said diverted path and beyond for returning said cam pin to said first step.

28. The machine of claim 27 wherein said means for returning said cam pin to said first step comprises a gradual change of said cam slot from said different depth to said one depth.

* * * * *